United States Patent [19]

Durand et al.

[11] 4,264,334

[45] Apr. 28, 1981

[54] HEAVY FUEL-OIL COMPOSITIONS HAVING AN IMPROVED STABILITY UNDER STORAGE CONDITIONS

[75] Inventors: Jean-Pierre Durand, Chatou; François Dawans, Bougival; Alain Faure, Saint Chamond; Paul Maldonado, Saint Symphonin, all of France

[73] Assignees: Institut Francais du Petrole, Reuil-Malmalson; Elf-Union, Paris, both of France

[21] Appl. No.: 59,018

[22] Filed: Jul. 19, 1979

[30] Foreign Application Priority Data

Jul. 19, 1978 [FR] France ..... 78 22061

[51] Int. Cl.[3] ..... C10L 1/22

[52] U.S. Cl. ..... 44/62; 44/70; 44/72

[58] Field of Search ..... 44/62, 72, 70; 525/314

[56] References Cited

U.S. PATENT DOCUMENTS 3,687,148 8/1972 Kruka et al. ..... 208/370

FOREIGN PATENT DOCUMENTS 2183157 12/1973 France .

*Primary Examiner*—Winston A. Douglas
*Assistant Examiner*—Y. Harris-Smith
*Attorney, Agent, or Firm*—Millen & White

[57] ABSTRACT

Heavy fuel-oil composition of improved stability under storage conditions, comprising a petroleum residue obtained from a straight run distillation, a vacuum distillation or a viscosity reduction of petroleum materials, a diluent such as a steam-cracking residue, a viscosity reduction gas oil or a mixture thereof, and a minor proportion of a sequenced copolymer formed of two polymeric sequences (A) and (B) wherein sequence (A) is obtained by polymerization of one or more conjugated diolefins such as 1,3-butadiene and isoprene and sequence (B) is obtained by polymerization of acrylonitrile or an alkylacrylonitrile such as methacrylonitrile, said sequenced copolymer having an average molecular weight by number of from 1,000 to 20,000.

18 Claims, No Drawings

HEAVY FUEL-OIL COMPOSITIONS HAVING AN IMPROVED STABILITY UNDER STORAGE CONDITIONS

This invention concerns compositions of heavy fuel-oils, based on petroleum residues the stability of which (in particular with respect to the evolution with time of the viscosity characteristics) is improved by adding polymeric additives.

The manufacture of heavy fuel-oils and particularly No. 2 heavy fuel-oils from petroleum residues is currently performed by "fluxing" said residues with diluents, in order to obtain suitable viscosity characteristics. These petroleum residues may particularly consist of crude oil straight-run or vacuum-distillation residues. The diluents generally used are distillates of relatively low viscosity, such as gas-oils. In view of the high cost of this type of diluents, it is desirable to make use of other products of lower value, such, in particular, as the steam-cracking residues, which have a low viscosity, a low sulfur content and a low content of metals and which could constitute very good diluents for the treatment of viscous petroleum residues. However, mixtures of these constituents suffer, in most cases, of incompatibilities which result in a viscosity increase in the course of time and/or in the formation of sediments. This is also the case when distillation residues (straight-run or vacuum-residues) or even residues from a visco-reduction unit are diluted with visco-reduction gas oils. As a general rule, such phenomena are observed when a petroleum residue or a mixture of petroleum residues is to be diluted with one or more "fluxing" agents of evoluting character (such as the above mentioned steam-cracking residues or visco-reduction gas-oils).

It has now been discovered that it was possible to improve the stability of the heavy fuel-oils having the above composition, by adding thereto a sufficient proportion of certain polymeric additives: these additives are sequenced co-polymers (conjugated dienes-acrylonitrile or alkyl acrylonitrile), optionally hydrogenated, as more precisely defined in the following description of the invention.

The compositions of heavy fuel-oils of the invention may be defined as comprising a mixture of:

(a) at least one petroleum residue selected from the straight-run distillation residues, the vacuum-distillation residues and the visco-reduction residues; and (b) at least one diluent selected from steam-cracking residues and visco-reduction gas-oils;

and a sufficient proportion, for improving the stability of said mixtures, of at least one sequenced copolymer consisting essentially of a sequence (A) resulting from the (co)polymerization of one or more conjugated diolefins and one or more sequences (B) resulting from the polymerization of acrylonitrile or an alkylacrylonitrile in which the alkyl group contains, for example, from 1 to 20 carbon atoms.

As advantageous examples of sequences (A), there can be mentioned those consisting essentially of:

homopolymeric chains based on 1,3-butadiene, copolymeric chains based on 1,3-butadiene and isoprene, these sequences being optionally completely or partially saturated by hydrogenation. In the case of homopolymeric chains based on 1,3-butadiene saturated by hydrogenation, the content of 1,2 units must be sufficient to make the polymers soluble in the mixture to be stabilized. For this purpose, it is preferred in this case to have a proportion of at least 50% of 1,2 units.

Moreover, in the sequenced copolymers, the one or more sequence(s) is (are) in most cases based on methacrylonitrile or acrylonitrile. In addition, the nitrogen-containing units are preferably cyclized. As a matter of fact, polymethacrylonitrile or polyacrylonitrile chains comprise recurring units of the following type:

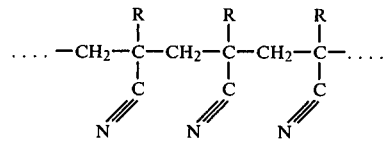

(wherein R=H in the case of polyacrylonitrile sequences and R=$CH_3$ in the case of polymethacrylonitrile sequences).

These chains can be cyclized either thermally or in the presence of nucleophile compounds such as, for example, carboxylic acids, phenols, caustic soda, butyllithium or butylmagnesium bromide and they generate structures of the following type:

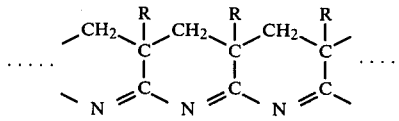

which results in a coloration of the polymer due to the formation of conjugated C=N bonds. In some cases, this cyclization may occur spontaneously, particularly during anionic polymerization of acrylonitrile or methacrylonitrile.

The average molecular weight by number of the sequenced copolymers according to the invention is generally from 1,000 to 20,000, preferably from 2,000 to 10,000. Their nitrogen-containing monomer content (i.e. the proportion of (B) sequences) may be for example from 0.1 to 10% by weight, preferably from 0.5 to 5% by weight.

Among the sequenced copolymers as above defined, the invention particularly concerns the bisequenced copolymers of type (A)—(B) and the trisequenced copolymers, particularly those of type (B)—(A)—(B), where (A) and (B) have each the above-mentioned definition.

The products used according to the invention, as precedingly defined, may be prepared by any usual technique leading to sequenced copolymers; however, whenever possible, the anionic polymerization is preferred, said technique having, on the one hand, the advantage of a greater flexibility for obtaining sequenced copolymers and, on the other hand, resulting in the direct production of a sequence (B) in which the recurring units are partially cyclized.

In this case, there can be used usual anionic polymerization catalysts. It is advantageous to proceed by preforming a sequence (A) by adding the one or more selected monomers to an alkyllithium or organo-sodium solution. When this one or more compound(s) has (or have) been polymerized, the nitrogen-containing monomer (acrylonitrile or alkylacrylonitrile) is introduced and the polymerization is continued so as to form the one (or more) sequence(s) (B). The obtained sequenced copolymers may be subjected to a further hydrogenation. The hydrogenation may be conducted according to conventional techniques, preferably in the presence of catalysts obtained by reacting transition metal derivatives such, for example, as carboxylates or acetylacetonates, with organoreducing compounds such, for example, as organo-aluminum or organolithium compounds or their hydrides.

The heavy fuel-oil compositions which can be treated according to the invention, by adding minor proportions of sequenced copolymers as precedingly defined, may consist more particularly of:

mixtures in variable proportions of straight-run distillation residues or vacuum-distillation residues and steam-cracking residues;

mixtures in variable proportions of straight-run distillation residues or vacuum-distillation residues and visco-reduction gas-oils;

mixtures in variable proportions of visco-reduction residues and visco-reduction gas-oils; or still mixtures containing variable proportions of straight-run distillation residues or vacuum-distillation residues, visco-reduction residues and visco-reduction gas-oils.

To these compositions, are added the above-defined sequenced copolymers in sufficient proportion to substantially reduce the viscosity increase during time as well as the formation of sediments. This proportion may vary for example from 0.001 to 1% by weight. The more commonly used proportions are from about 0.01 to 0.2% by weight.

The invention is illustrated in greater detail in the following examples, which are not limitative thereof.

EXAMPLE 1

In a reactor, a mixture of 57 g of 1,3-butadiene and 37 g of isoprene is added to a solution of 12.5 mmoles of butyllithium in 250 ml of n-heptane. The reaction mixture is stirred for 5 hours at 50° C., which results in a complete conversion of the monomers to a butadiene-isoprene copolymer having a butadiene content of 60% by weight and an average molecular weight by number of 5700.

To the resultant reaction mixture, there is added 4.7 g of methacrylonitrile and the polymerization is continued for 1 hour at 50° C. The copolymer is separated by precipitation in acetone and dried under reduced pressure up to constant weight. There is thus obtained a sequenced copolymer [(butadiene-isoprene)-methacrylonitrile] containing 0.5% by weight of nitrogen, i.e. 2.4% by weight of methacrylonitrile.

This product is added in a proportion of 0.1% by weight to a mixture consisting of 59% by weight of an Aramco vacuum-residue having a viscosity of 4800 cst at 50° C. and 41% by weight of a steam-cracking residue having a viscosity of 41.2 cst at 50° C., an initial distillation point of 210° C. and a specific gravity, at 15° C., of 1.065. The viscosity of the mixture stored at 90° C. is measured in the course of time. The results are summarized in Table I, showing the beneficial effect of the presence of the additive on the stability of the mixture as compared to the same mixture stored under the same conditions but without additive.

EXAMPLE 2

In a reactor, there is added 94 g of 1,3-butadiene to a solution of 12.5 mmoles of butyllithium and 9 g of tetrahydrofuran in 250 ml of n-heptane. The reaction mixture is stirred for 5 hours at 50° C., resulting in a complete conversion of the monomer to polybutadiene containing 60% of 1,2 units and 40% of 1,4 units and having an average molecular weight by number close to 7000.

To the reaction mixture obtained at the end of the polymerization of 1,3-butadiene, there is added 3.5 g of methacrylonitrile and the polymerization is continued for 1 hour at 50° C., so as to obtain a butadiene methacrylonitrile sequenced copolymer.

This product, separated as in example 1, is added in proportion of 0.1% by weight to the mixture of vacuum-residue and steam-cracking residue of example 1. The resulting mixture is stored at 90° C. for several days and the viscosity, measured in the course of time (Table I), shows the good stability of the mixture.

EXAMPLE 3

In the conditions of example 2, anything else being otherwise the same, the sequenced polybutadiene-methacrylonitrile copolymer is hydrogenated in the presence of a suspension resulting from the reaction of 100 mg of cobalt as octoate with 600 mg of triethylaluminum, at 130°–140° C. for 6 hours under a hydrogen pressure of 25 bars. The obtained hydrogenated copolymer is added in a proportion of 0.1% by weight to the mixture of vacuum-residue and steam-cracking residue of example 1. The mixture including the additive is stored at 90° C. for several days and the viscosity, in the course of time (Table I), shows the good stability of the mixture.

EXAMPLE 4

When, in the conditions of example 2, everything else being otherwise unchanged, the butadiene-methacrylonitrile sequenced copolymer is added in a proportion of 0.1% by weight to a mixture consisting of 65% by weight of an Aramco vacuum-residue and 35% by weight of a steam-cracking residue having a viscosity of 18 cst at 50° C., there is obtained a mixture the good stability of which during storage at 90° C. is shown by the results reported also in Table I.

TABLE I

Stability of the vacuum residue and steam-cracking residue mixtures

| VISCOSITY AT 50° C. (cst) OF THE MIXTURE AFTER | WITHOUT ADDITIVE | EXAMPLE 1 | EXAMPLE 2 | EXAMPLE 3 | EXAMPLE 4 |
|---|---|---|---|---|---|
| 1 hour | 433 | 388 | 380 | 375 | 375 |
| 3 hours | 524 | 408 | 403 | 400 | 401 |
| 18 hours | 595 | 426 | 420 | 412 | 415 |
| 8 days | 650 | 436 | 430 | 420 | 426 |
| 32 days | 760 | 438 | 432 | 425 | 430 |
| 40 days | 1050 | 440 | 432 | 425 | 431 |

EXAMPLE 5

When, in the conditions of example 2, anything else being otherwise unchanged, methacrylonitrile is replaced with acrylonitrile, there is obtained a butadiene-acrylonitrile sequenced copolymer. Said copolymer is added in a proportion of 0.05% by weight to a mixture consisting of 60% by weight of an Aramco vacuum residue having a viscosity of 4800 cst at 50° C. and 40% by weight of a visco-reduction gas oil having a viscosity of 19.5 cst at 50° C. The resulting mixture is stored at 90° C. for several days and the viscosity, measured in the course of time, shows a good stability of the mixture as compared with the same mixture without additive (Table 2).

EXAMPLE 6

In a reactor, there is introduced 100 g of 1,3-butadiene in 250 ml of n-heptane and 40 ml of a solution containing 0.5 mole of sodium naphthalene per liter of tetrahydrofuran. The reaction mixture is stirred for 4 hours at 40° C. and 4 g of methacrylonitrile are then added thereto. The polymerization is continued for 1 hour at 40° C.

The obtained sequenced copolymer is added to the vacuum residue and visco-reduction gas oil mixture of example 5 in a proportion of 0.05% by weight. This mixture is stored at 90° C. for several days and the viscosity, in the course of time, shows the good stability of the resulting mixture as compared with that of the mixture without additive (Table 2).

EXAMPLE 7

When, in the conditions of example 6, everything else being otherwise unchanged, methacrylonitrile is replaced with acrylonitrile, there is obtained a vacuum residue+visco-reduction gas oil+sequenced copolymer composition having a good stability, as shown by the results reported in Table 2 below.

TABLE 2

Stability of the vacuum residue/visco-reduction gas oil mixtures

| VISCOSITY AT 50° C. (cst) OF THE MIXTURE After: | WITHOUT ADDITIVE | EXAMPLE 5 | EXAMPLE 6 | EXAMPLE 7 |
|---|---|---|---|---|
| 1 hour | 420 | 380 | 378 | 381 |
| 3 hours | 512 | 395 | 392 | 400 |
| 18 hours | 580 | 412 | 408 | 417 |
| 8 days | 630 | 422 | 419 | 428 |
| 32 days | 740 | 428 | 422 | 428 |
| 40 days | 985 | 429 | 422 | 430 |

EXAMPLE 8

When the sequenced copolymer obtained in the conditions of example 6 is added in a proportion of 0.1% by weight, to a mixture consisting of 55% by weight of a visco-reduction residue having a viscosity of 21 500 cp at 50° C. and 45% by weight of a visco-reduction gas oil having a viscosity of 19.5 cst at 50° C., there is obtained a mixture having a good stability during storage at 90° C., as shown by the results reported in Table 3.

TABLE 3

Stability of a visco-reduction residue/visco-reduction gas oil mixture

| VISCOSITY at 50° C. (cst) of the MIXTURE after: | WITHOUT ADDITIVE | EXAMPLE 8 |
|---|---|---|
| 1 hour | 435 | 382 |
| 3 hours | 532 | 397 |
| 18 hours | 610 | 413 |
| 8 days | 680 | 425 |
| 32 days | 810 | 427 |
| 40 days | 1020 | 429 |

EXAMPLE 9

When the sequenced copolymer obtained in the conditions of example 6 is added in a proportion of 0.1% by weight to a mixture consisting of 30% by weight of Aramco vacuum residue having a viscosity of 4800 cst at 50° C., 28% by weight of a visco-reduction residue having a viscosity of 21 500 cp at 50° C. and 42% by weight of a visco-reduction gas oil having a viscosity of 19.5 cst at 50° C., there is obtained a mixture having a good stability during its storage at 90° C., as shown by the results reported in Table 4.

TABLE 4

Stability of a vacuum residue - visco-reduction residue-visco-reduction gas oil mixture

| VISCOSITY at 50° C. (cst) of the MIXTURE after: | WITHOUT ADDITIVE | EXAMPLE 9 |
|---|---|---|
| 1 hour | 440 | 380 |
| 3 hours | 529 | 398 |
| 18 hours | 610 | 415 |
| 8 days | 670 | 427 |
| 32 days | 802 | 429 |
| 40 days | 1060 | 430 |

EXAMPLE 10

The sequenced copolymer obtained in the conditions of example 6 is added in a proportion of 0.1% by weight to a mixture consisting of 41% by weight of visco-reduction residue having a viscosity of 8400 cp at 50° C., 22% by weight of vacuum-residue originating from BUZURGAN and having a viscosity of 7100 cst at 50° C., 10% by weight of a mixture in a proportion of 75:25 by weight of LCO (light cycle oil) having a viscosity of 1.9 cst at 50° C. and of HCO (high cycle oil) having a viscosity of 5.4 cst at 50° C., and 27% by weight of visco-reduction gas oil having a viscosity of 19.5 cst at 50° C. There is obtained a mixture having a good stability during its storage at 90° C., as shown by the results of Table 5 below.

TABLE 5

Stability of a visco-reduction residue - vacuum residue-visco-reduction gas-oil-LCO-HCO mixture

| VISCOSITY at 50° C. (cst) of the MIXTURE after: | WITHOUT ADDITIVE | EXAMPLE 10 |
|---|---|---|
| 1 hour | 460 | 455 |
| 1 day | 510 | 465 |
| 6 days | 580 | 475 |
| 17 days | 670 | 474 |
| 32 days | 745 | 470 |
| 40 days | 960 | 472 |

What is claimed is:

1. A heavy fuel oil composition with improved viscosity stability which comprises a mixture of:
   (a) at least one petroleum residue selected from the straight-run distillation residues, the vacuum-distillation residues and the visco-reduction residues;
   (b) at least one diluent selected from the steam-cracking residues and the visco-reduction gas oils; and
   (c) a minor proportion, as a viscosity stabilizer, of at least one sequenced copolymer having a number average molecular weight of from 1,000 to 20,000, and formed of:
      a polymeric sequence (A) obtained by polymerization of one or more conjugated diolefins, and
      at least one polymeric sequence (B) obtained by polymerization of acrylonitrile or alkylacrylonitrile;
      whereby the heavy fuel oil composition has substantially improved viscosity stability during storage, as compared to the mixture of (a) and (b) alone which undergoes a substantial increase in viscosity during said storage period.

2. A composition according to claim 1, wherein, in the sequenced copolymer, sequence (A) results from the polymerization of 1,3-butadiene.

3. A composition according to claim 1, wherein, in the sequenced copolymer, the sequence (A) results from the copolymerization of 1,3-butadiene and isoprene.

4. A composition according to claim 1, wherein sequence (A) is at least partially saturated by hydrogenation.

5. A composition according to claim 1, wherein the one or more sequences (B) are essentially based on acrylonitrile.

6. A composition according to claim 1, wherein the one or more sequences (B) are essentially based on methacrylonitrile.

7. A composition according to claim 1, wherein the recurring units of the one or more sequences (B) are at least partially cyclized.

8. A composition according to claim 1, wherein the one or more sequences (B) are present in a proportion of 0.1 to 10% by weight of the sequenced copolymer.

9. A composition according to claim 8, wherein sequences (B) are present in a proportion from 0.5 to 5% by weight of the sequenced copolymer.

10. A composition according to claim 1, wherein the average molecular weight by number of the sequenced copolymer is from 2,000 to 10,000.

11. A composition according to claim 1, wherein said petroleum residue (a) consists essentially of a vacuum distillation residue and said diluent (b) consists essentially of a steam-cracking residue.

12. A composition according to claim 1, wherein said petroleum residue (a) consists essentially of a vacuum distillation residue and said diluent (b) consists essentially of a visco-reduction gas-oil.

13. A composition according to claim 1, wherein said petroleum residue (a) consists essentially of a visco-reduction residue and said diluent (b) consists essentially of a visco-reduction gas-oil.

14. A composition according to claim 1, wherein said petroleum residue (a) comprises a vacuum distillation residue and a visco-reduction residue and said diluent (b) comprises mainly a visco-reduction gas-oil.

15. A composition according to claim 1, wherein the proportion of the sequenced copolymer is from 0.001 to 1% by weight.

16. A composition according to claim 15, wherein the proportion of the sequenced copolymer is from 0.01 to 0.2% by weight.

17. A method of improving the viscosity stability of a heavy fuel-oil comprising a mixture of:

(a) at least one petroleum residue selected from the straight-run distillation residues, the vacuum-distillation residues and the visco-reduction residues; and (b) at least one diluent selected from the steam-cracking residues and the visco-reduction gas oils; said method comprising incorporating in said heavy fuel-oil an effective viscosity-stabilizing amount of at least one sequenced copolymer having a number average molecular weight of from 1,000 to 20,000, and formed of:

a polymeric sequence (A) obtained by polymerization of one or more conjugated diolefins, and at least one polymeric sequence (B) obtained by polymerization of acrylonitrile or alkylacrylonitrile;

whereby the resultant heavy fuel-oil composition has substantially improved viscosity stability during storage, as compared to the mixture of (a) and (b) alone which undergoes a substantial increase in viscosity during said storage period.

18. The method of claim 17, wherein said effective amount is from 0.001 to 1% by weight.

* * * * *